United States Patent [19]

Rakitsch

[11] Patent Number: 4,608,512

[45] Date of Patent: Aug. 26, 1986

[54] LAMP AND REFLECTOR COMBINATION, PARTICULARLY FOR PROJECTORS

[75] Inventor: Peter Rakitsch, Ismaning, Fed. Rep. of Germany

[73] Assignee: Patent-Treuhand-Gesellschaft für elektrische Glühlampen mbH, Fed. Rep. of Germany

[21] Appl. No.: 755,979

[22] Filed: Jul. 18, 1985

Related U.S. Application Data

[63] Continuation of Ser. No. 435,238, Oct. 19, 1982, abandoned.

[30] Foreign Application Priority Data

Nov. 4, 1981 [DE] Fed. Rep. of Germany ..... 3143776

[51] Int. Cl.[4] ..... H01K 1/50; H01K 1/26

[52] U.S. Cl. ..... 313/113; 313/579; 362/297

[58] Field of Search ..... 313/113, 114, 579; 362/297, 346

[56] References Cited

U.S. PATENT DOCUMENTS 3,241,437 3/1966 Thiels ..... 352/198 X
3,936,686 2/1976 Moore ..... 313/113 X
4,021,659 5/1977 Wiley ..... 362/297
4,277,821 7/1981 Sassmannshausen ..... 362/346
4,417,300 11/1983 Bodmer ..... 362/346 X

*Primary Examiner*—Palmer C. DeMeo
*Attorney, Agent, or Firm*—Frishauf, Holtz, Goodman & Woodward

[57] ABSTRACT

To prevent second-order like non-uniformities, that is, the cloud formation effect on the image plane of a projected light source, projecting light in a film window, the reflector (3) has a profile (p) which is discontinuous and formed of a sequence of conical surface segments (F) which are successively placed on the reflector from the apex to the rim and which have different angles with respect to the axis or center line (CL) of the reflector. Each one of the areal segments, in cross section, has a length (1) which is so dimensioned that the overall length of the images of the projected filament (2) of the lamp in the plane of the film window is equal to or larger than the diagonal of the image field, and adjacent segments intersect in a discontinuous reflector or profile in intersection circles which lie on a curve (K) forming a continuous reflector profile, which continuous reflector profile may be in accordance with any standard arrangement.

10 Claims, 2 Drawing Figures

LAMP AND REFLECTOR COMBINATION, PARTICULARLY FOR PROJECTORS

Figure 1:
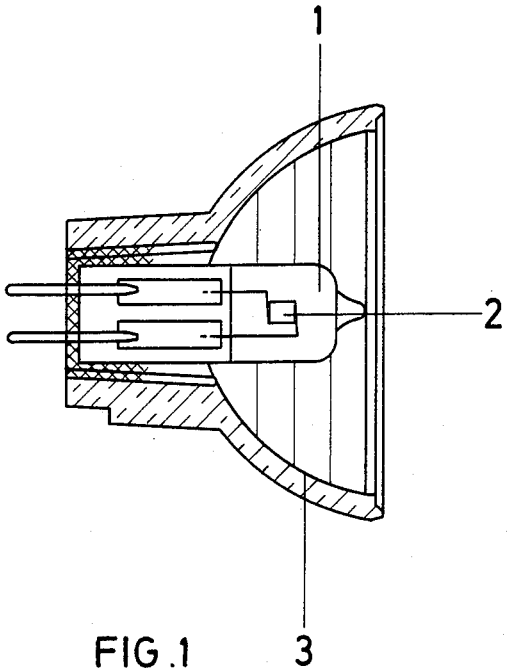

This application is a continuation of application Ser. No. 435,238, filed 10-19-82, and now abandoned.

The present invention relates to a lamp-and-reflector combination, particularly for projectors, and especially for projectors for amateur-type motion-picture film, transparencies, and the like. The structure and arrangement is, however, also applicable to projection lamps for other uses.

Background.

Modern projection lamps are frequently combined with a reflector into a single unit. One type of lamp which is particularly suitable for use with projectors is a halogen incandescent lamp. It can be used, for example, for projection of 8 mm motion-picture film with a ground glass.

The profile of the reflector of such combination lamp-reflector units may result in imaging of the filament of the incandescent lamp if the filament is very small and has a high primary winding pitch, while the picture window itself is large, and the image-forming objective has a relatively small aperture. If the projection structure is of this kind, localized non-uniformities in the illumination may result. The uniformity of the projection surface of the first order, also known as the G1 uniformity, and so defined in industrial standard DIN 15 148, provides a suitable definition for the basic illumination across a diagonal of the imaging plane. This first-order uniformity may be unaffected by the concurrence of the aforementioned conditions. The uniformity of second order, which may also be termed cloud formation, is, however, disturbed.

It has previously been proposed—see German Pat. No. 1,203,116—to provide a discontinuous profile for the reflector. This was done in order to improve the uniformity of first order. As proposed, the reflector is formed as a composite of a plurality of reflective plane surface areas, located with respect to each other at different angles. The inclination of the respective surface regions is so selected that the images of the filament which are reflected thereby in the vicinity of the optical axis are spaced apart to a greater extent than these images removed from the optical axis, that is, near the periphery. All images of the filament are adjacent each other. The filament images which are projected by different surface areas do not coincide.

The Invention.

It is an object to provide a combination lamp-reflector in which the aforementioned localized irregularities in illumination of the projection surface, e.g. the ground glass, do not occur. Thus, the uniformity of illumination of second order also will be maintained.

Briefly, in accordance with the invention, the profile of the reflector is discontinuous. The reflector is formed by areal segments in the form of conical surfaces, which are successively placed on the reflector at different angles with respect to the reflector axis. Each of these areal segments has a length, within the discontinuous profile of the reflector, which is so dimensioned that the overall length of the projection of the reflected filaments of the lamp, in the plane of the image field or window, is equal or larger than the image field diagonal. Adjacent areas intersect in the discontinuous reflector profile in points which are on a curve which represents a continuous theoretical profile of the reflector, which theoretical, continuous profile follows a known and standard curve.

Forming the reflector as a series of conical surfaces results in projection of a bundle of projected images of the filament in the imaging plane or plane of the window such that the respective images of the filament, within the bundle of images, are offset with respect to height; all the bundles of the images of the filaments commonly overly the imaging plane at the imaging window.

DRAWINGS

Figure 2:
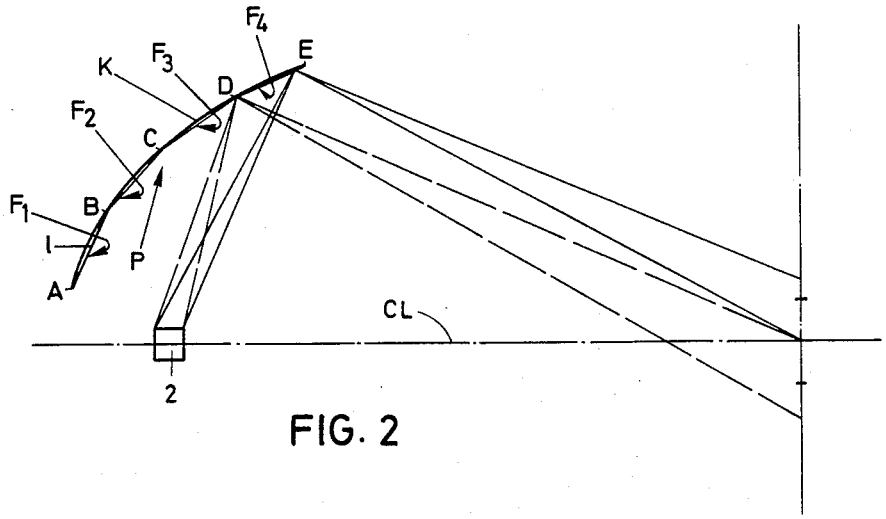

FIG. 1 is a vertical sectional view through a lamp-reflector combination using a halogen incandescent lamp with a generally ellipsoid reflector; and FIG. 2 is an enlarged detail schematic view of the discontinuous profile of the reflector of the lamp-reflector combination of FIG. 1.

A halogen cycle incandescent lamp 1 has a filament 2 and is assembled to a reflector 3 to form a single structural unit—see FIG. 1. As best seen in FIG. 2, the reflector 3 has a discontinuous reflector profile P. The reflector profile P is formed by areal or surface segments $F_1$, $F_2$, $F_3$, $F_4$. Each one of the areal or surface segments is shaped in the form of a truncated cone-shaped shell, sequentially placed on the reflector at a respectively different angle with respect to the axis or center line CL of the lamp and reflector. Each one of the surface sections F has a length l. The respective lengths l of the surfaces preferably differ. The length l of any surface F is a function of the length of the filament, as seen from the film window and reflected by the reflector, see FIG. 2, and the image rays there shown.

The dimension l is so arranged that the length of the imaged filament in the plane of the film window is not substantially less, preferably of equal size or larger than the diagonal of the image field. Adjacent surface regions F intersect at points B, C, D. These intersecting points—or, rather, intersecting circles in three dimensions—form, in cross section and as seen in FIG. 2, points on a curve K. The curve K is a continuous curve, representative of a continuous reflector profile, which is well known as such, and used for projection purposes. It may, for example, be a continuous reflector profile of a known halogen ellipsoid reflector lamp, and referred to above. Each surface area F projects, thus, a bundle of images of the filament of the lamp towards the plane of the image window in such a manner that the respective separate images of the filaments within the bundle are offset in a vertical direction—see FIG. 2. All the bundles of the images of the filaments commonly or together cover the plane of the film window, superimposed above each other.

In a preferred form, thirteen surface regions F are used. The length l of the respective surface regions, as seen in FIG. 2, decreases to 1.15 mm adjacent the rim of the reflector. The intersecting points—with respect to the cross-sectional view of FIG. 2—of adjacent surfaces are placed on a curve K which is defined by the equation:

$$0.1339x^2+1.2570xy+y^2-31.028x+57.-14y-1513.4=0.$$

The length l at the apex is about 1.73 mm.

I claim:

1. A lamp bulb and reflector combination for projectors, to project a beam of light on a film window of predetermined size, in a film window plane, having a light source or bulb (1) with a filament (2);

and a generally ellipsoid-shaped reflector having a reflective surface which is substantially symmetrical about a central axis or centerline (CL) and is positioned to surround the light source, to reflect light therefrom and form said beam, wherein the reflective surface (3) has a cross-sectional profile (P), in any selected plane incorporating said centerline (CL), which is not a continuous curve, but rather is formed of a sequence of surface or areal segments (F) having a common central axis or centerline (CL), each segment being in the form of a, circumferentially continuous truncated cone-shaped shell, the reflective surfaces of the truncated cone-shaped shells formed by said segments each having in said cross-sectional profile, respectively, a different angle with respect to the axis or centerline (CL) of the reflector;

wherein each of the areal segments has, in cross section, a length (l), between points (A, B, C, D, E) along said profile where said segment meets adjacent segments, which is so dimensioned that the overall length of images of the projected filament (2) of the lamp in the plane of a film window perpendicular to said centerline (CL) is equal to or larger than the diagonal of the image field, and wherein adjacent areal segments intersect, in the discontinuous reflector profile, in intersection circles which lie on a curve (K) forming a theoretical continuous reflector profile.

2. A combination according to claim 1, wherein thirteen areal segments (F) are provided, and the length (l) of the cone-shaped areal segment in the region of the apex of the reflector is about 1.73 mm, and the length of the segment in the region of the rim of the reflector is about 1.15 mm, said length (l) of the respective reflector segments descreasing from the region of the apex towards the rim.

3. A combination according to claim 1, wherein the theoretical curve on which the discontinuous reflector segments intersect each other is defined by:

$$0.1339x^2+1.2570xy+y^2-31.028x+57.-14y-1513.4=0.$$

4. A combination according to claim 3, wherein thirteen areal segments (F) are provided, and the length (l) of the cone-shaped areal segment in the region of the apex of the reflector is about 1.73 mm, and the length of the segment in the region of the rim of the reflector is about 1.15 mm, said length (l) of the respective reflector segments decreasing from the region of the apex towards the rim.

5. A combination according to claim 1, wherein the light bulb is a halogen incandescent lamp.

6. A combination according to claim 2, wherein the light bulb is a halogen incandescent lamp.

7. A combination according to claim 3, wherein the light bulb is a halogen incandescent lamp.

8. A combination according to claim 4, wherein the light bulb is a halogen incandescent lamp.

9. A combination according to claim 1, wherein a plurality of said areal segments are provided, each so reflecting light from the light source as to produce a filament image offset with respect to the filament image produced by each of the other segments.

10. A combination according to claim 9, wherein at least thirteen segments are provided.

* * * * *